US007293523B1

(12) United States Patent
Lentz

(10) Patent No.: US 7,293,523 B1
(45) Date of Patent: Nov. 13, 2007

(54) FLAG-SUPPORTING MOUNT FOR RECREATIONAL VEHICLES AND THE LIKE

(76) Inventor: Ronald D. Lentz, 2816 London La., Flower Mound, TX (US) 75028

( * ) Notice: Subject to any disclaimer, the term of this patent is extended or adjusted under 35 U.S.C. 154(b) by 0 days.

(21) Appl. No.: 11/199,706

(22) Filed: Aug. 10, 2005

(51) Int. Cl.
*G09F 17/00* (2006.01)

(52) U.S. Cl. ..... 116/173; 116/28 R; 248/512; 40/591; 340/425.5

(58) Field of Classification Search ..... 116/173–175, 116/28 R, 35 R, 42, DIG. 36; D10/109–110; D11/181–182, 16; D12/162; 248/512, 514, 248/538, 540; 40/590–591, 218, 643; 362/473–477, 362/485, 487–507; 340/463–479, 425.5
See application file for complete search history.

(56) References Cited

U.S. PATENT DOCUMENTS

| | | | | | |
|---|---|---|---|---|---|
| D46,363 | S | | 9/1914 | Heller | |
| 1,308,340 | A | * | 7/1919 | Deibel et al. | 40/413 |
| 1,413,267 | A | * | 4/1922 | Grover | 116/173 |
| 2,260,787 | A | * | 10/1941 | Nichols et al. | 248/513 |
| 3,540,685 | A | * | 11/1970 | Gualano | 248/515 |
| 3,762,360 | A | * | 10/1973 | Hawes | 116/28 R |
| 4,311,262 | A | * | 1/1982 | Morin | 294/141 |
| 4,593,877 | A | | 6/1986 | van der Wyk | |
| 4,768,690 | A | * | 9/1988 | Stoutenburg | 224/557 |
| 4,986,209 | A | * | 1/1991 | Spica | 116/28 R |
| 5,087,012 | A | | 2/1992 | Doublet | |
| 5,089,803 | A | * | 2/1992 | Bohn | 340/425.5 |
| 5,732,927 | A | | 3/1998 | Purpura | |
| 5,786,758 | A | * | 7/1998 | Bullock | 340/539.32 |
| 6,010,107 | A | | 1/2000 | Goldfarb | |
| 6,179,311 | B1 | * | 1/2001 | Larkin et al. | 280/154 |
| 6,295,945 | B1 | | 10/2001 | Amanze | |
| 6,298,803 | B1 | * | 10/2001 | Gregg | 116/28 R |
| 2006/0086307 | A1 | * | 4/2006 | Kaz | 116/28 R |

* cited by examiner

*Primary Examiner*—Richard Smith
*Assistant Examiner*—Tania C Courson

(57) ABSTRACT

An apparatus includes a housing that has planar walls defining a cavity. One wall has annular holes formed therein. An anchor plate is nested within the cavity and provided with apertures situated subjacent to the holes. Each aperture has a diameter equal to a diameter of the holes. One aperture is vertically situated below one of the holes. The other apertures are inwardly offset from their associated holes. Flags are positioned through the holes and apertures. A bottom wall is provided with apertures for directing undesirable fluids and debris out from the cavity. A mechanism is included for illuminating one rod and includes a switch and a fuse box. A light-emitting source is mounted to a front wall, confronts a front face of one flag, and emits a light beam upwardly along the shaft thereof. A mechanism is included for removably mounting the housing onto the recreational vehicle.

6 Claims, 5 Drawing Sheets

FLAG-SUPPORTING MOUNT FOR RECREATIONAL VEHICLES AND THE LIKE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to flag-supporting mounts and, more particularly, to a flag-supporting mount for recreational vehicles and the like.

2. Prior Art

One method of showing support for a sports club, professional organization, political group or country is by flying pennants, logos, flags or indicia on a vehicle. Various patents have proposed different methods of securing a pennant, logo, flag or indicia on a vehicle. Each existing patent, however, has its drawbacks and limitations.

One example shows a vehicle window-mounted mast. One of the disadvantages of the vehicle window-mounted flag is the excessive noise they produce when the vehicle is in motion. The noise originates from two sources, one being the flapping of the flag by wind gust, and the other being road noise resulting from the fact that the door or window cannot be tightly shut. Another disadvantage of the vehicle window-mounted flag is the road hazard they could cause should the vehicle window be lowered when the vehicle is in motion. There is tendency for wind force to forcefully remove the flag from the window, thus causing a hazard for other vehicles on the road.

Another example shows a flag system limited only to the hood of a vehicle. A flag that is so positioned cannot easily be seen, and thus the purpose of the flag system is essentially lost. A further example describes a car door flag holder, whereby, upon closing of the door a flag holder bracket will be securely clamped between the door and doorjamb. Whereas, upon opening the door, the flag holder bracket will unfortunately fall off.

Yet another example shows a vehicle antenna mounting flag. Drawback in this design is that the wind force generated by the flag is transferred to the antenna. The force may exceed the antenna's structural capabilities and thus cause the antenna to damage. Moreover, not all vehicles are equipped with a rod antenna. Similarly, suction cup and magnetic base mounted flag masts exhibit the disadvantage of being adversely affected by wind force, when the force is transferred to the holding bases. Should the holding base separate from where it was stuck, the disengagement may cause the invention to act as a projectile, thus creating a hazard situation to other road users. Moreover, pennants, logos, flags or indicia that depend on magnetic forces are limited to metallic vehicle panels.

Accordingly, a need remains for a flag-supporting mount for recreational vehicles and the like in order to overcome the above-noted shortcomings. The present invention satisfies such a need by providing flag-supporting mount that is easy to use, attractive in design, and has the ability to display one's affiliation with multiple groups, countries or organizations. Instead of being unable to express interest and pride in a particular social event or gathering, a person can use the flag-supporting mount to display their support and pride. Such a flag-supporting mount provides a quick and easy way to hoist selected flags for display in a prominent location of the vehicle.

BRIEF SUMMARY OF THE INVENTION

In view of the foregoing background, it is therefore an object of the present invention to provide a flag-supporting mount for recreational vehicles and the like. These and other objects, features, and advantages of the invention are provided by an apparatus for supporting flags at an erected position.

The apparatus includes a housing that has a plurality of monolithically connected planar walls defining a cavity therebetween. One of the walls has a plurality of annular holes formed therein and equidistantly spaced apart along a linear path. The housing includes an anchor plate nested within the cavity and provided with a plurality of annular apertures situated subjacent to the holes respectively. Each of the apertures has a diameter equal to a diameter of the holes wherein one of the apertures is vertically and axially situated below an associated one of the holes. Other ones of the apertures are inwardly offset from associated ones of the holes. A bottom one of the walls is provided with a plurality of apertures for conveniently directing undesirable fluids and debris out from the cavity.

A plurality of flag assemblies are selectively positioned through the holes and apertures respectively such that a lower portion of the flag assemblies maintain a fixed spatial relationship after being inserted through the anchor plate. Such flag assemblies are removably engageable directly with the housing. Each flag assembly preferably includes an elongated and tubular shaft that has axially opposed end portions interfitted below the anchor plate and terminating at a predetermined distance above the housing respectively. Such a shaft has a plurality of apertures spaced along a top one of the end portions thereof. The tubular shaft includes male and female portions telescopically engageable along a linear path.

A banner is provided with a plurality of openings along one edge portion thereof. A plurality of fasteners are removably connected directly to the banner openings and the shaft apertures. Such fasteners include S-shaped hooks. The banner is effectively suspended above the housing and adjacent to one of the end portions of the shaft.

A mechanism is included for illuminating at least one of the shafts during operating conditions. Such an illuminating mechanism includes a switch and a fuse box electrically mated to an existing power supply source of the recreational vehicle. A light-emitting source is directly mounted to a front one of the walls wherein the light-emitting source confronts a front face of at least one of the flag assemblies. Such a light-emitting source emits a light beam upwardly along one of the shafts of the flag assemblies.

A mechanism is included for mounting the housing onto the recreational vehicle such that the housing confronts and abuts a rear portion of the recreational vehicle. Such a mounting mechanism is removably attached directly to the housing. The mounting mechanism preferably includes a pair of oppositely disposed L-shaped plates directly conjoined to a bottom one of the walls. Such plates are equidistantly offset from a centrally registered latitudinal axis passing through the housing. The plates include a top face flush-mounted directly against a bottom one of the walls and extending rearwardly from the housing.

In an alternate embodiment, the mounting mechanism may include a cylindrical tube that has a top end portion directly conjoined to a bottom one of the walls and further has an open bottom end portion removably seated about a fifth-wheel trailer hitch.

In another embodiment, the mounting mechanism preferably includes a pair of oppositely disposed mounting plates that have first and second monolithically formed portions directly conjoined to outer ones of the walls and directly secured to a rear portion of the recreational vehicle respectively.

In yet a further embodiment, the mounting mechanism preferably includes an A-frame bracket including a pair of flat plates obliquely offset from a rear one of the walls and diverging away from the housing towards the recreational vehicle for allowing a user to connect the housing directly to a corner edge of the recreational vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
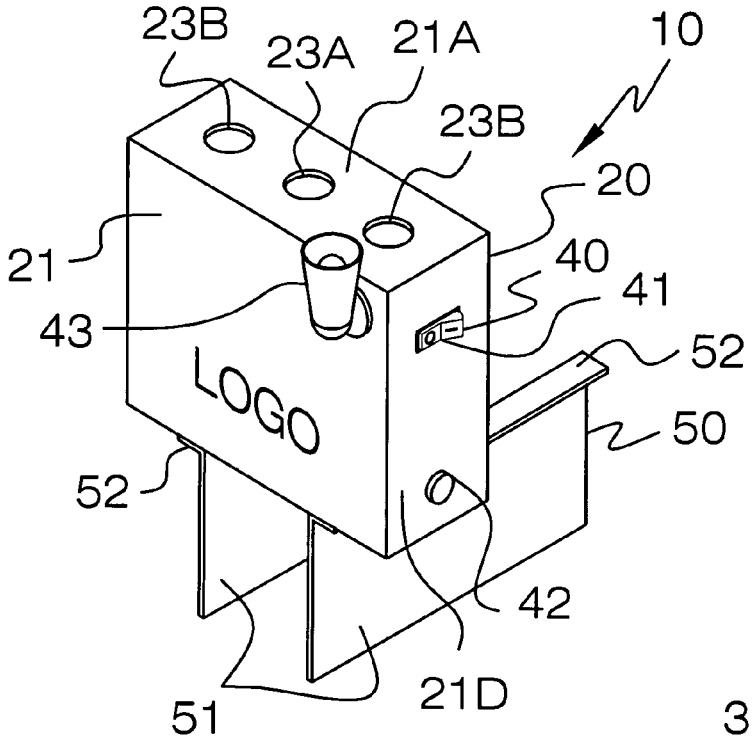
FIG. 1 is a front perspective view showing a flag-supporting mount for recreational vehicles and the like, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime, double prime and triple prime numbers refer to alternate embodiments of such elements.

The apparatus of this invention is referred to generally in FIGS. 1-7 by the reference numeral 10 and is intended to provide a flag-supporting mount for recreational vehicles and the like. It should be understood that the apparatus 10 may be used to mount flags to many different types of vehicles and should not be limited in use to only recreational vehicles.

Figure 2:
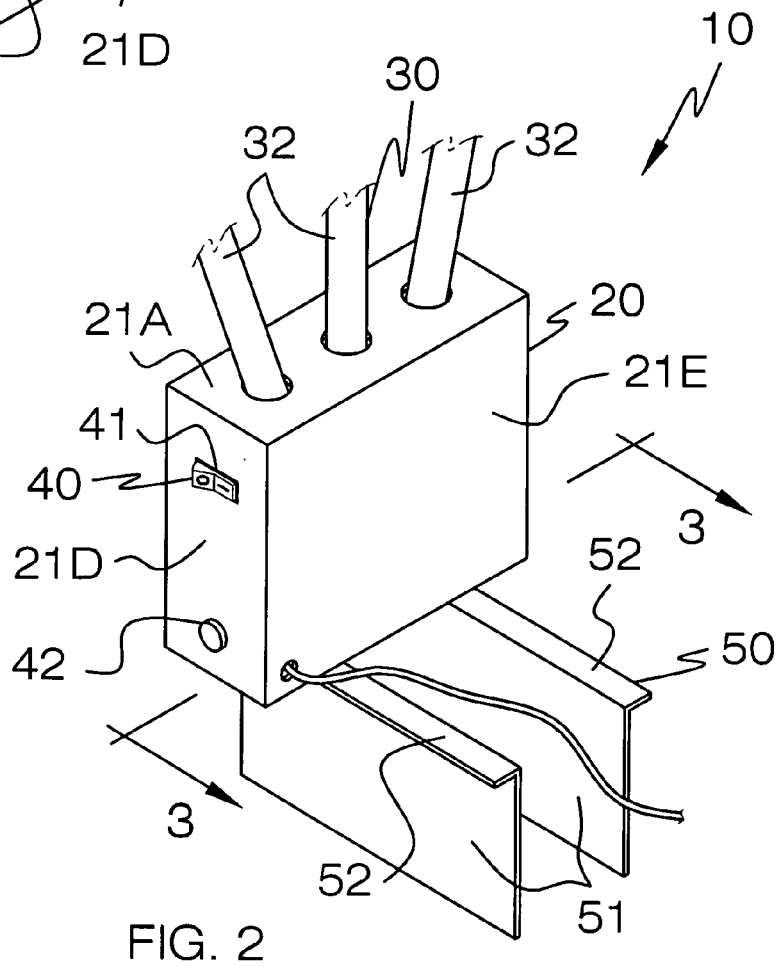
FIG. 2 is a rear perspective view of the apparatus shown in FIG. 1, showing the shafts mounted therein.
Figure 3:
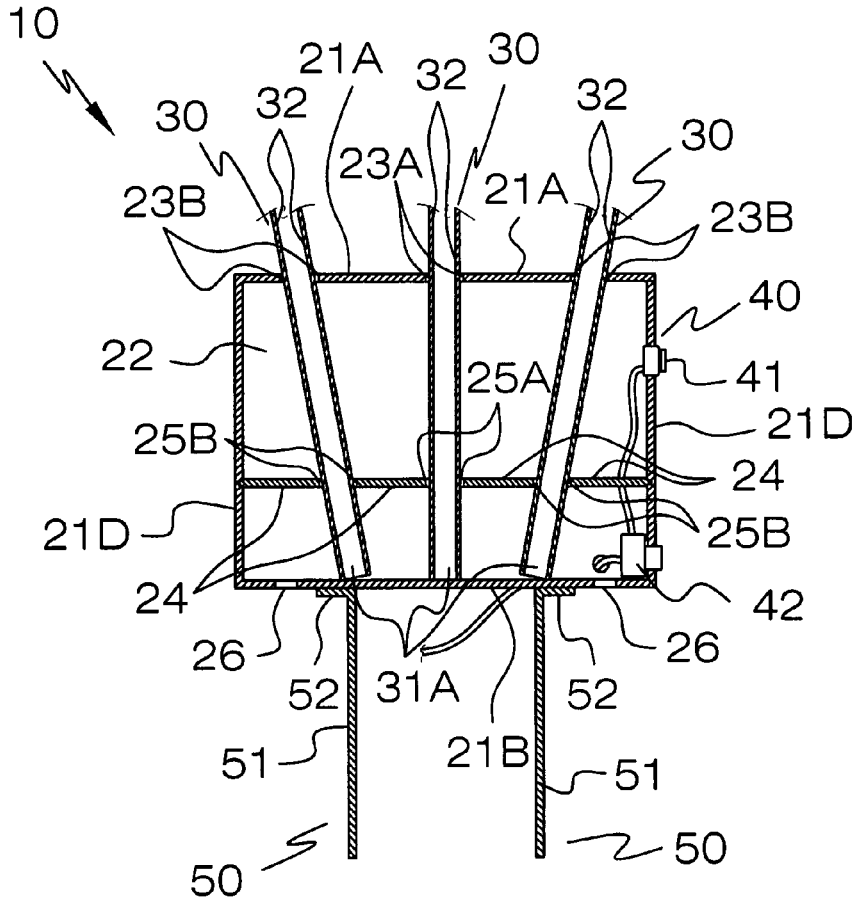
FIG. 3 is a cross-sectional view of the apparatus shown in FIG. 2, taken along line 3-3 and showing the anchor plate within the housing.

Referring initially to FIGS. 1 through 3, the apparatus 10 includes a housing 20 that has a plurality of monolithically connected planar walls 21 defining a cavity 22 therebetween. Of course, the housing 20 may be produced in a variety of different shapes, sizes and colors so as to match various types of vehicles, as is obvious to a person of ordinary skill in the art. One of the walls 21A has a plurality of annular holes 23 formed therein and equidistantly spaced apart along a linear path. The housing 20 includes an anchor plate 24 nested within the cavity 22 and provided with a plurality of annular apertures 25 situated subjacent to the holes 23 respectively, as is best shown in FIG. 3. Each of the apertures 25 has a diameter equal to a diameter of the holes 23 wherein one of the apertures 25A is vertically and axially situated below an associated one 23A of the holes 23. Other ones of the apertures 25B are inwardly offset from associated ones 23B of the holes 23. A bottom one 21B of the walls 21 is provided with a plurality of apertures 26 that are essential and advantageous for conveniently directing undesirable fluids and debris out from the cavity 22, thus preventing such fluid and debris from adversely affecting the apparatus 10.

Referring to FIGS. 2 through 5, a plurality of flag assemblies 30 are selectively positioned through the holes 23 and apertures 25 respectively such that a lower portion 31A of the flag assemblies 30 maintain a fixed spatial relationship after being inserted through the anchor plate 24. Such flag assemblies 30 are removably engageable directly, with no intervening elements, with the housing 20. Each flag assembly 30 includes an elongated and tubular shaft 32 that has axially opposed end portions 31 interfitted below the anchor plate 24 and terminating at a predetermined distance above the housing 20 respectively. Such a shaft 32 has a plurality of apertures 33 spaced along a top one 31B of the end portions 31 thereof. The tubular shaft 32 includes male 32A and female 32B portions telescopically engageable along a linear path.

Figure 4:
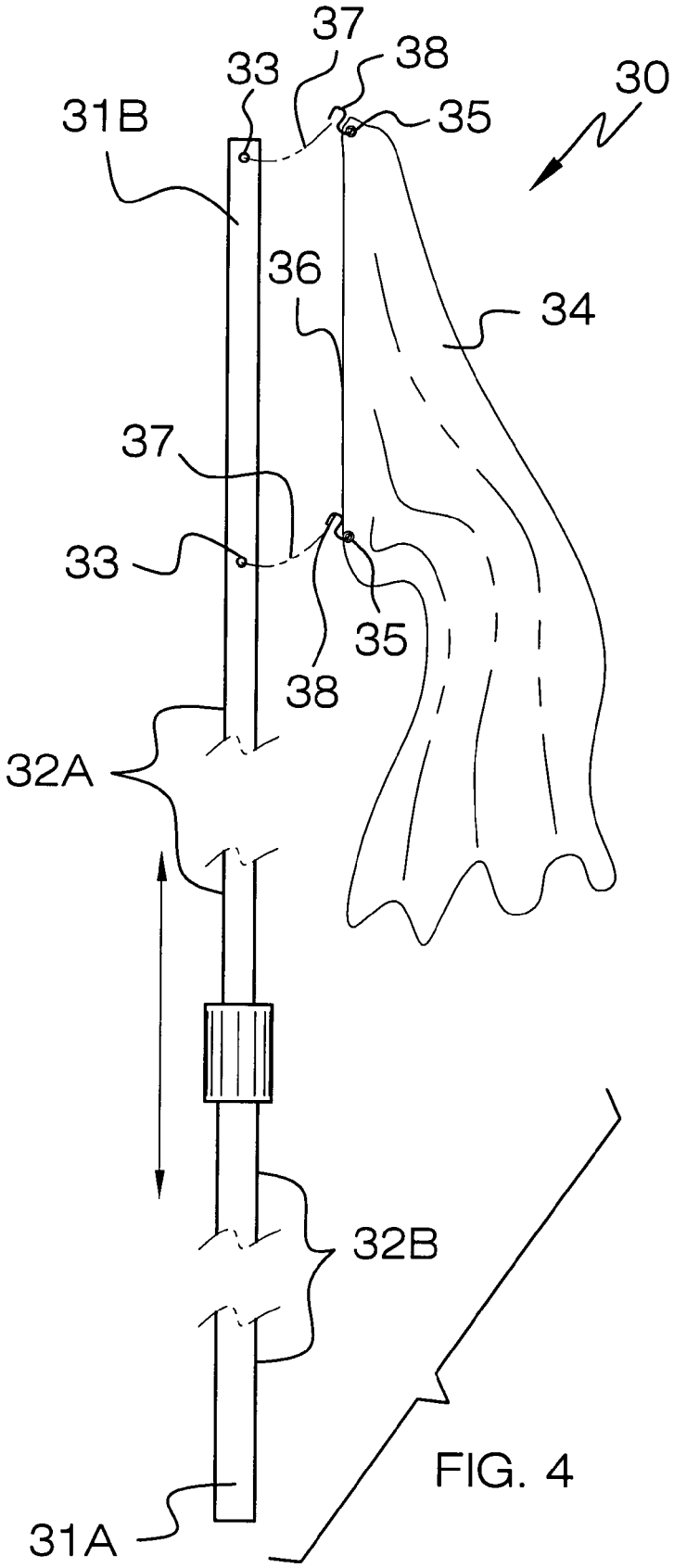
FIG. 4 is a side-elevational view of the flag assembly, in accordance with the present invention.
Figure 5:
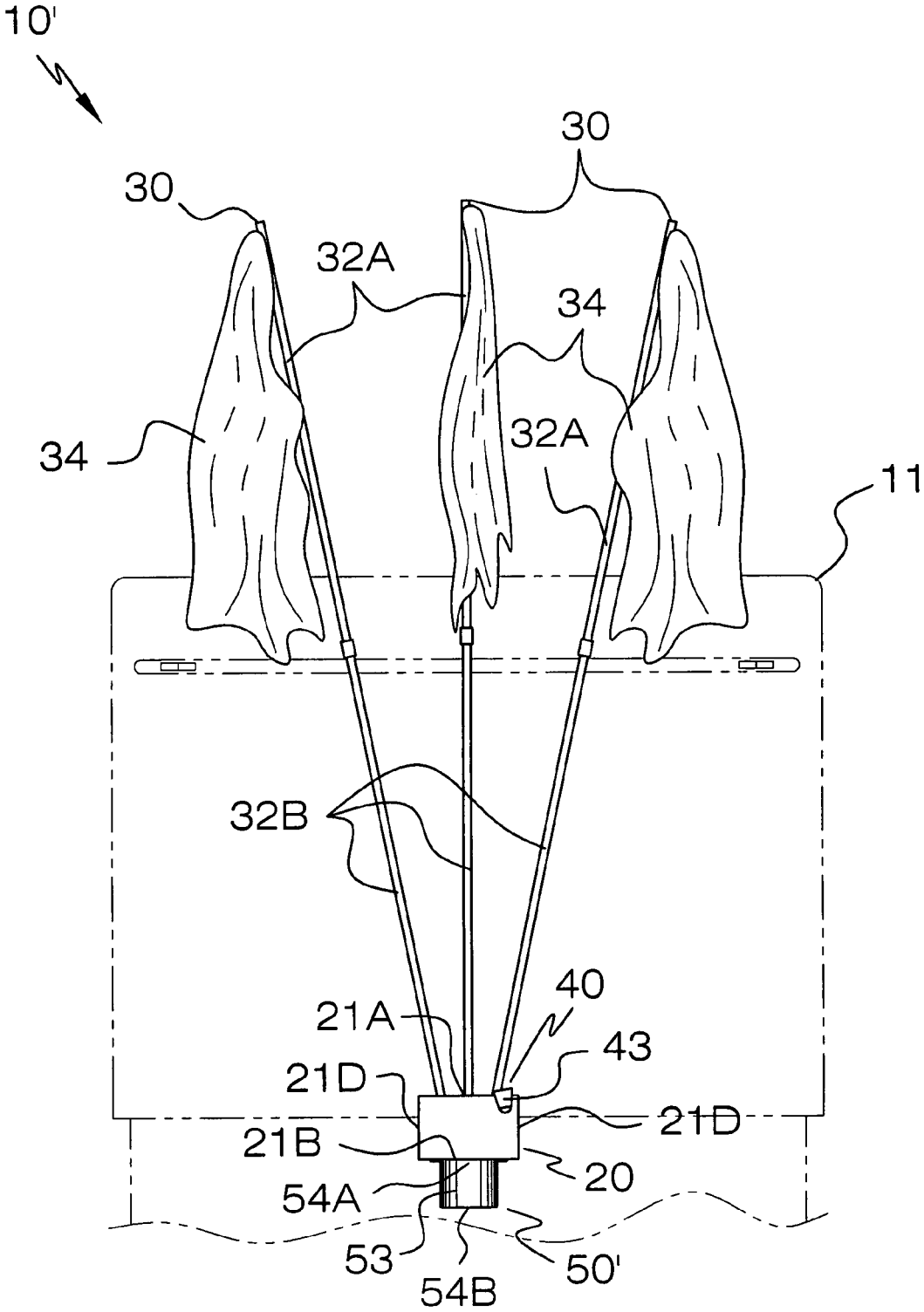
FIG. 5 is a front-elevational view showing an alternate embodiment of the mounting mechanism shown in FIGS. 1 and 2.

Referring to FIGS. 4 and 5, a banner 34 is provided with a plurality of openings 35 along one edge portion 36 thereof. A plurality of fasteners 37 are removably connected directly, with no intervening elements, to the banner openings 25 and the shaft apertures 33. Such fasteners 37 include S-shaped hooks 38. The banner 34 is effectively suspended above the housing 20 and adjacent to one of the end portions 31B of the shaft 32.

Referring to FIGS. 1, 2, 3 and 5, a mechanism 40 is included for illuminating at least one of the shafts 32 during operating conditions. Such an illuminating mechanism 40 includes a switch 41 and a fuse box 41 electrically mated to an existing power supply source of the recreational vehicle 11. A light-emitting source 43 is directly mounted, with no intervening elements, to a front one 21C of the walls 21 wherein the light-emitting source 43 confronts a front face of at least one of the flag assemblies 30. Such a light-emitting source 43 emits a light beam upwardly along one of the shafts 32 of the flag assemblies 30.

Referring to FIGS. 1 through 3, a mechanism 50 is included for mounting the housing 20 onto the recreational vehicle 11 such that the housing 20 confronts and abuts a rear portion of the recreational vehicle 11. Such a mounting mechanism 50 is removably attached directly, with no intervening elements, to the housing 20. The mounting mechanism 50 includes a pair of oppositely disposed L-shaped plates 51 directly conjoined, with no intervening elements, to a bottom one 21B of the walls 21. Such plates 51 are equidistantly offset from a centrally registered latitudinal axis passing through the housing 20. The plates 51 include a top face 52 flush-mounted directly, with no intervening elements, against a bottom one 21A of the walls 21 and extending rearwardly from the housing 20.

Referring to FIG. 5, in an alternate embodiment 10', the mounting mechanism 50' includes a cylindrical tube 53 that has a top end portion 54A directly conjoined, with no intervening elements, to a bottom one 21B of the walls 21 and further has an open bottom end portion 54B removably seated about a fifth-wheel trailer hitch (not shown).

Figure 6:
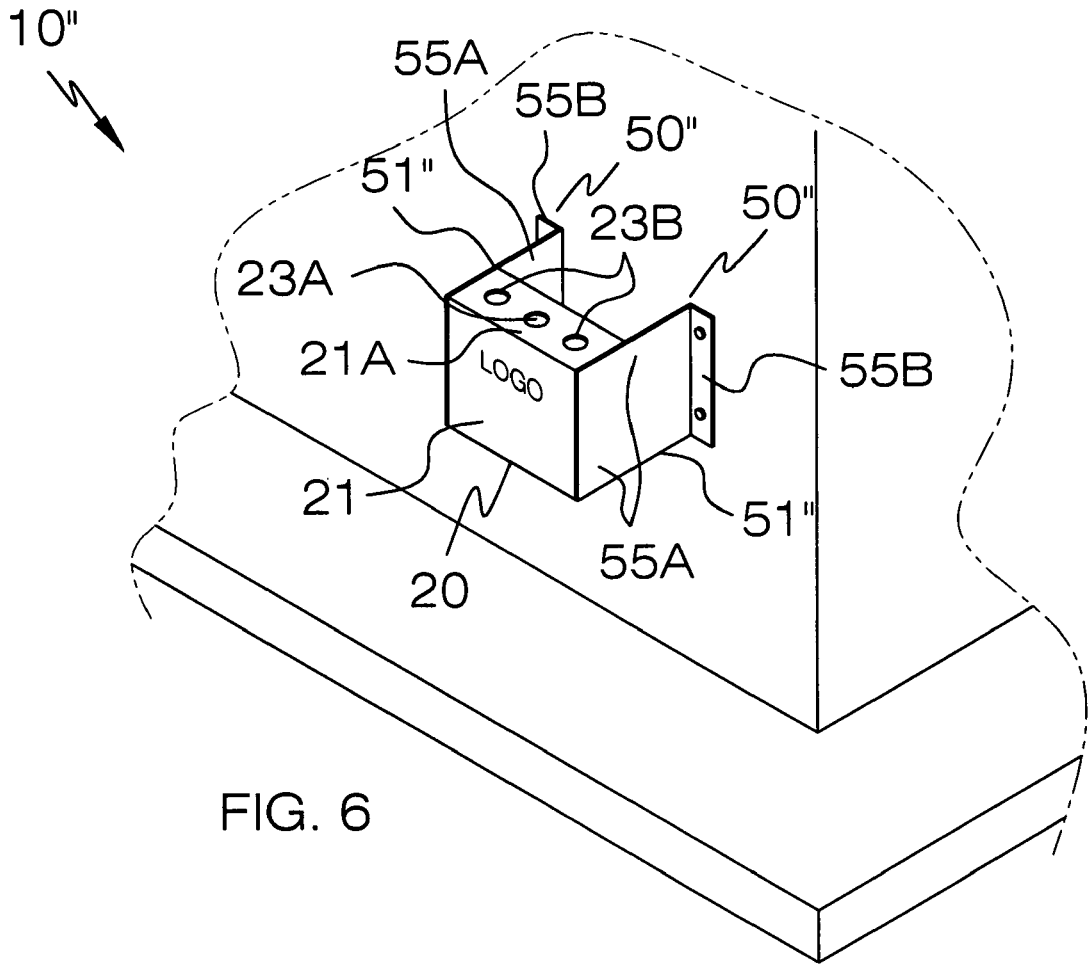
FIG. 6 is a perspective view showing another embodiment of the mounting mechanism shown in FIGS. 1 and 2, showing the mounting plates attached to the side walls of the housing.

Referring to FIG. 6, in another alternate embodiment 10", the mounting mechanism 50" includes a pair of oppositely disposed mounting plates 51" that have first 55A and second 55B monolithically formed portions 55 directly conjoined, with no intervening elements, to outer ones 21D of the walls 21 and directly secured, with no intervening elements, to a rear portion of the recreational vehicle 11 respectively.

Figure 7:
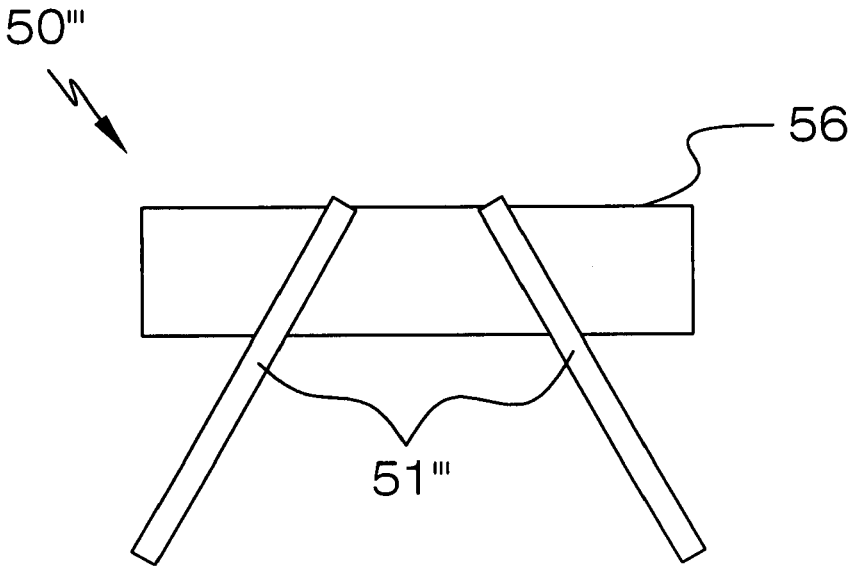
FIG. 7 is a bottom plan view showing yet a further embodiment of the mounting mechanism shown in FIGS. 1 and 2.

Referring to FIG. 7, in a further alternate embodiment 10''', the mounting mechanism 50''' includes an A-frame bracket 56 including a pair of flat plates 51''' obliquely offset from a rear one 21E of the walls 21 and diverging away from the housing 20 towards the recreational vehicle 11, which is vital for allowing a user to connect the housing directly, with no intervening elements, to a corner edge of the recreational vehicle 11.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for supporting flags at an erected position, said apparatus comprising:

a housing having a plurality of monolithically connected planar walls defining an enclosed cavity therebetween, a top one of said walls having a plurality of annular holes formed therein and equidistantly spaced apart along a linear path, said housing including an anchor plate nested within the cavity and provided with a plurality of annular apertures situated subjacent the holes respectively, said anchor plate having planar top and bottom surfaces and being registered parallel to said top wall and a bottom wall of said housing, each of the apertures having a diameter equal to a diameter of the holes wherein one of the apertures is vertically and axially situated below an associated one of the holes, other ones of the apertures being inwardly offset from associated ones of the holes;

a plurality of flag assemblies selectively positioned through the holes and apertures respectively such that a lower portion of said flag assemblies maintain a fixed spatial relationship after being inserted through said anchor plate, said flag assemblies being removably engageable directly with said housing, said bottom wall being provided with a plurality of apertures for directing undesirable fluids and debris out from the cavity;

means for illuminating at least one said flag assemblies during operating conditions, wherein said illuminating means comprises:

a switch and a fuse box electrically mated to an existing power supply source of the recreational vehicle;

a light-emitting source directly mounted to a front one of said walls wherein said light-emitting source confronts a front face of at least one said flag assemblies, said light-emitting source emitting a light beam upwardly along one said shafts of said flag assemblies; and means for mounting said housing onto the recreational vehicle such that said housing confronts and abuts a rear portion of the recreational vehicle, said mounting means being removably attached directly to said housing.

2. The apparatus of claim 1, wherein each said flag assemblies comprises:

an elongated and tubular shaft having axially opposed end portions interfitted below said anchor plate and terminating at a predetermined distance above said housing respectively, said shaft having a plurality of apertures spaced along a top one of said end portions thereof, wherein said tubular shaft includes male and female portions telescopically engageable along a linear path;

a banner provided with a plurality of openings along one edge portion thereof; and a plurality of fasteners removably connected directly to said banner openings and said shaft apertures, wherein said fasteners include S-shaped hooks, said banner being suspended above said housing and adjacent one said end portions of said shaft.

3. The apparatus of claim 1, wherein said mounting means comprises:

a pair of oppositely disposed L-shaped plates directly conjoined to a bottom one of said walls, said plates being equidistantly offset from a centrally registered latitudinal axis passing through said housing, said plates including a top face flush-mounted directly against a bottom one of said walls and extending rearwardly from said housing.

4. The apparatus of claim 1, wherein said mounting means comprises:

a cylindrical tube having a top end portion directly conjoined to a bottom one of said walls and further having an open bottom end portion removably seated about a fifth-wheel trailer hitch.

5. The apparatus of claim 1, wherein said mounting means comprises:

a pair of oppositely disposed mounting plates having first and second monolithically formed portions directly conjoined to outer ones of said walls and directly secured to a rear portion of the recreational vehicle respectively.

6. The apparatus of claim 1, wherein said mounting means comprises:

an A-frame bracket including a pair of flat plates obliquely offset from a rear one of said walls and diverging away from said housing towards the recreational vehicle for allowing a user to connect said housing directly to a corner edge of the recreational vehicle.

* * * * *